United States Patent [19]

Clement

[11] 4,037,917

[45] July 26, 1977

[54] FIELD INSTALLED FUSE REJECTION MEANS WITH SPRING BETWEEN CLIP JAWS

[75] Inventor: Ralph C. Clement, Bellefontaine, Ohio

[73] Assignee: I-T-E Imperial Corporation, Spring House, Pa.

[21] Appl. No.: 650,691

[22] Filed: Jan. 20, 1976

[51] Int. Cl.[2] ..... H01H 85/24

[52] U.S. Cl. ..... 339/259 F; 337/226

[58] Field of Search ..... 339/184 R, 186 R, 219 F, 339/252 F, 253 F, 256 C, 258 F, 259 F, 262 F; 337/215, 225, 226; 85/8.3, 8.8

[56] References Cited

U.S. PATENT DOCUMENTS

| | | | |
|---|---|---|---|
| 1,040,331 | 10/1912 | Horton | 339/253 F |
| 3,198,913 | 8/1965 | Stanback | 339/258 F |
| 3,812,756 | 5/1974 | Wegner | 85/8.8 |
| 3,858,058 | 12/1974 | Tillson | 339/258 F |

*Primary Examiner*—Roy Lake
*Assistant Examiner*—Neil Abrams
*Attorney, Agent, or Firm*—Ostrolenk, Faber, Gerb & Soffen

[57] ABSTRACT

A rejector pin member is field installable between the spring-loaded clip jaws of a terminal clip receiving a terminal blade of a cartridge fuse. The rejector pin allows the terminal clip to only accept a notched terminal blade of a fuse having a relatively low current rating and rejects the unnotched terminal blade of a cartridge fuse having a relatively high current rating, to prevent formation of an overcurrent heating hazard in the circuit protected by the fuse.

8 Claims, 4 Drawing Figures

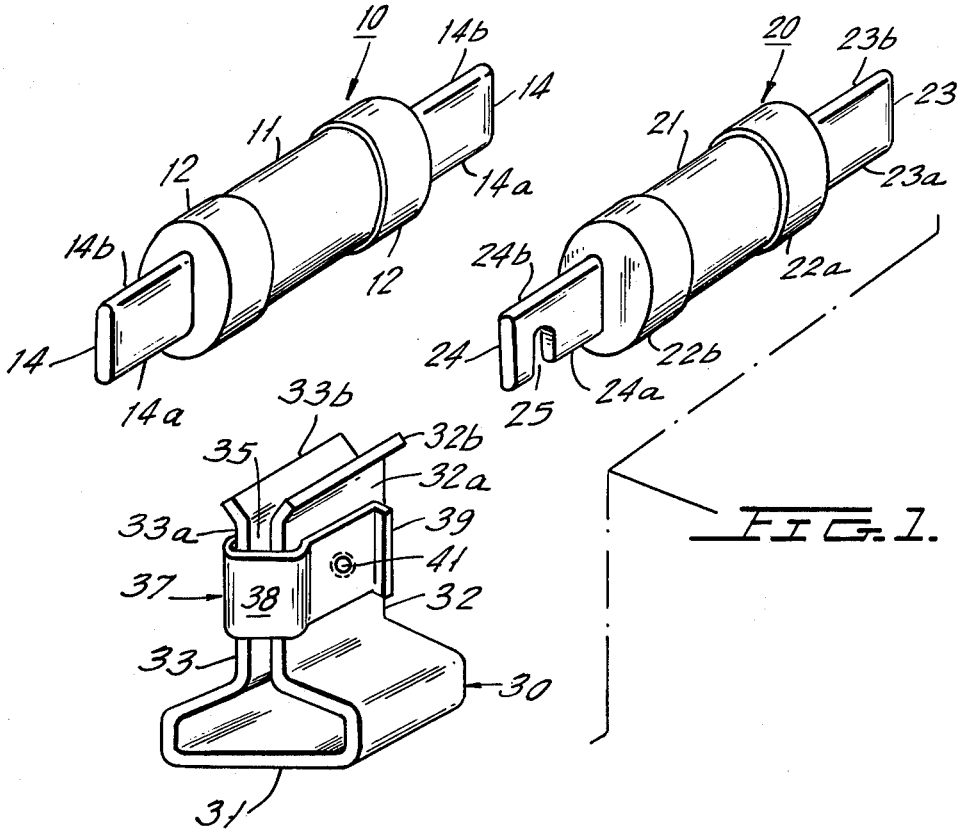
FIG. 1.
FIG. 2.
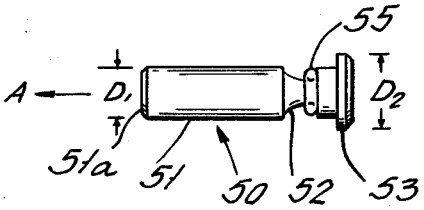
FIG. 3.
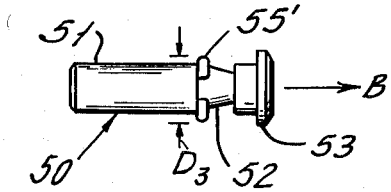
FIG. 4.
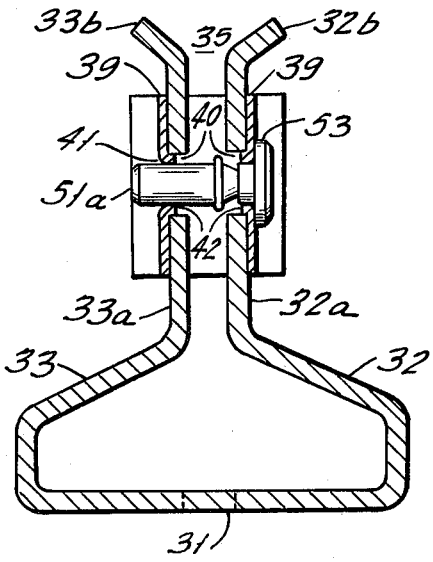

FIELD INSTALLED FUSE REJECTION MEANS WITH SPRING BETWEEN CLIP JAWS

BACKGROUND OF THE INVENTION

This invention relates to means for preventing over fusing, and more particularly to means of this type especially adapted for use with cartridge fuses having a notched terminal blade.

Electric cartridge fuses rated 100 Amperes and higher are provided with blade-type terminals adapted for insertion into a fuse holder comprising a spaced pair of fuse clips fastened to an insulating base. Conventionally, spring means are used to bias the jaws of each clip together to reliably contact and hold the terminal blade within the clip jaws. For one particular class of fuses having a relatively low range of rated currents, a notch is formed partially through the width of one of the flat terminal blades. Another particular class of fuse, having relatively higher rated current, is provided with flat terminal blades without notches.

The conventional fuse clip accepts the terminal blade of either class of cartridge fuse. A circuit having a relatively high current rating may have a fuse of lower rated current installed within its terminal clips to protect a load device having a current rating less than the circuit rating. Conversely, if a cartridge fuse having a current rating in excess of the circuit current rating is installed in a conventional fuse clip, an overcurrent fault hazard is present and the fuse will not provide current interruption and protection in the event of an overcurrent fault of magnitude sufficient to damage the circuit but less than the current rating of the fuse.

It is therefore desirable to provide means for usewith a spring-bias terminal clip to facilitate installation of a notched terminal blade while preventing installation of a cartridge fuse having a higher current rating and an unnotched terminal blade. The rejection means must be capable of being field installed in a relatively simple manner in a fuse clip, preferably without requiring the use of tools, and must be extremely difficult to remove once installed to prevent subsequent unauthorized removal.

BRIEF SUMMARY OF THE INVENTION

In accordance with the invention, a fuse clip having a pair of spaced parallel clip jaws adapted to receive a flat terminal blade of a cartridge fuse, and having a U-shaped spring member with its free arms pressing the clip jaws of the terminal resiliently toward each other, is provided with a rejector pin passing through aligned apertures in both free arms of the spring and the underlying portions of both clip jaws. The diameter of the rejector pin is selected to enter a considerable distance into the notch formed in the terminal blade of a relatively low current rating cartridge fuse.

A one-piece rejector pin has a tapering neck converging toward a head portion having a greater diameter than the exterior diameter of the remaining rejector pin portion. A C-spring is installed around the tapering neck to have a normally-expanded outer diameter greater than the pin diameter. The apertures have a diameter greater than the pin diameter but less than the outer diameter of the expanded C-spring to allow the spring to be compressed for insertion through a single clip arm and spring arm. The C-spring is then released to expand to prevent withdrawal of the pin, while the rejection member head prevents passage of the rejector pin completely through the aligned apertures. The C-spring is located in an area of the fuse clip inaccessible to normal tools and cannot be removed unless the fuse clip is rendered completely unusable.

The notch in the terminal blade of a cartride fuse having a relatively lower current rating fits around the rejector pin to allow proper insertion and retention of the notched terminal blade in the fuse clip. The pin is positioned in the fuse clip to interfere with the edge of a normal, unnotched terminal blade to prevent its insertion into the fuse clip, thus providing rejection means for preventing the installation of a cartridge fuse of higher current rating.

It is, therefore, one object of the present invention to provide a terminal blade clip with means for accepting only notched terminal blades to prevent installation of a cartridge fuse having a detrimentally high current rating.

It is another object of the present invention to provide such rejection means capable of being field installed in the terminal clip without the use of tools.

It is a further object of the present invention to provide such rejection means which is incapable of being removed from the terminal clip with ordinarily available tools.

These and other objects of the present invention will be understood upon a reading of the following detailed description and the drawings.

DETAILED DESCRIPTION OF THE DRAWINGS

FIG. 1 is a perspective view of a high current-rating cartridge fuse having unnotched terminal blades; a relatively low current-rating cartridge fuse having one notched terminal blade; and of conventional spring-reinforced terminal clip for forming an electrical connection to the terminal blades of either fuse;

FIG. 2 is a side view of a rejector pin having its keeper spring in the compressed condition;

FIG. 3 is a side view of a rejector pin having its keeper spring in the expanded condition; and FIG. 4 is a cross-section of the spring-reinforced terminal clip with the rejector pin installed in accordance with the principles of the present invention.

DETAILED DESCRIPTION OF THE INVENTION

Referring now to FIG. 1, a relatively high rated-current fuse 10 is comprised of a cylindrical body 11 of insulating material enclosing a fusible element (not shown for purpose of simplicity). An end cap 12 of conductive material is suitably fastened to enclose each end of body 11 and to electrically contact one of the opposed ends of the fusible element. A flat terminal blade 14 extends from each end cap 12 in a direction away from insulating body 11. Terminal blades 14, 14 lie in a common plane and each terminal blade has a pair of parallel, unbroken edge surfaces 14*a*, 14*b*.

Another cartridge fuse 20 of relatively lower rated-current is comprised of an insulating portion 21 having conductive caps 22*a* and 22*b* at opposed ends thereof. A flat and unnotched terminal blade 23 extends from a first end cap 22*a* in a direction away from insulating portion 21. Another flat terminal blade 24 extends from the remaining conductive end cap 22*b* in a direction opposite that of terminal blade 23. Terminal blades 23 and 24 are aligned in the same plane and each has a pair of parallel edges 23*a*, 23*b* and 24*a*, 24*b*, respectively. Terminal blade 24 has a substantially rectangular notch 25 formed into one edge 24*a* thereof and extending a significant distance toward the remaining edge 24*b*.

A conventional terminal clip 30 comprises a web portion 31 including means (not shown) for mounting web 31 to a flat surface, and a pair of clip arms 32 and 33 extending transverse to the plane of web 31. Each clip arm 32 and 33 includes a flat portion 32*a* and 33*a* parallel to the flat portion of the other clip arm and a canted portion 32*b*, 33*b* disposed at and diverging from the end of parallel flat portions 32*a*, 33*a*, respectively, furthest from web 31. Terminal clip 30 is conventionally formed of a high-conductivity metallic substance, such as metallic copper and the like, which material advantageously possesses a natural resiliency tending to force spaced parallel clip portions 32*a* and 33*a* towards each other to define a narrow blade-receiving gap 35 therebetween. A U-shaped reinforcing spring 37 has a web 38 and a pair of parallel arms 39, with each arm extending from an opposite side of web 38. Reinforcing spring 37 is advantageously formed of a very resilient material, such as springsteel or the like, and has a distance between facing interior surfaces of arms 39 less than the normal distance between the parallel exterior faces of arms 32*a* and 33*a* of clip 30 to resiliently force their interior surfaces even closer together to narrow gap 35.

An aperture 40 is formed approximately through the center of each flat clip arm portion 32*a* and 33*a*. The axes of apertures 40, 40 are in alignment parallel to the plane of web 31 (FIG. 4). Each reinforcing spring 39 has a corresonding aperture 41 of diameter D formed therethrough. Apertures 41 are formed by piercing arms 39 from their exterior surfaces inwardly towards gap 39 in a manner to cause a swaged portion 42 to be formed, which swaged portion 42 enters an associated clip arm aperture 40 to resiliently lock reinforcing spring 37 to terminal clip 30.

In accordance with the invention, a rejector member 50 (FIG. 2) has a cylindrical pin portion 51 of substantially constant outer diameter $D_1$ from which portion a tapering neck 52 converges toward a head portion 53 having an outer diameter $D_2$ greater than the diameter $D_1$ of pin portion 51. A C-shaped keeper spring 55 is resiliently retained about neck 52.

Rejector member 50 is installed in blade clip 30 by intially positioning face 51*a* of pin portion 51 within one aperture 41 of a spring arm 39. The aperture diameter D is greater than pin outer diameter $D_1$ and less than head outer diameter $D_2$. Rejector member 50 is pressed in the direction of arrow A while C-shaped spring 55 is compressed about the narrow portion of conical neck 52 to close the spring to an outer diameter allowing pin portion 51 and compressed spring 55 to pass through both the first aperture 41 and the underlying clip aperture 40 until pin portion 51 enters and passes through the clip aperture 40 and overlying spring aperture 41 in the opposite blade (FIG. 4). Keeper spring 55 is then released to expand to its normal outer diameter which is selected to be greater than spring aperture diameter D. Head 53, having a diameter $D_2$ greater than aperture diameter D, prevents passage of rejector pin 50 completely through the passage formed by aligned apertures 40, 40 and 41, 41. The length of rejector pin 50 is established to prevent removal of pin portion 51 from spring arm aperture 41 for all normal widths of gap 35.

Attempted removal of rejector pin 50 requires the application of force to the rejector member in the direction of arrow B. Movement in this direction causes keeper spring 55 to ride up along the tapering face of conical neck 52 to expand to a final outer diameter $D_3$ greater than the diameter of spring arm aperture41 to prevent removal of rejector member 50 from the spring arm while simultaneously preventing removal of reinforcing spring 37 from terminal clip 30. Thus, rejector member 50 is modified by keeper spring 55 to be a device initially capable only of limited axial movement through apertures 40 and 41 in a single direction when spring 55 is compressed and, upon insertion, the normal expansion of the keeper spring prevents movement in either axial direction.

Keeper spring 55 is normally positioned in or adjacent to one of clip arm apertures 40 to prevent access to spring 55 with conventional tools, thus defeating attempts to compress and remove the keeper spring from the rejector member.

Notch 25 in blade 24 of low rated-current fuse 20 cooperates with rejector pin 50 to allow blade 24 to fully enter gap 35, whereby the interior surfaces of parallel clip arms 32*a* and 33*a* resiliently bear against the exterior opposed faces of the terminal blade to assure proper electrical contact thereto. The unnotched blade 14 of the relatively high rated-current fuse 10 cannot enter gap 35 to a sufficient depth to be permanently retained therein against the force of reinforcing sprig 37 tending to narrow gap 35, and the unnotched blade is expelled therefrom in a direction away from web 31 to prevent its installation therein.

There has just been described a novel field installable fuse rejector member for use with a terminal clip having a spring member between its clip jaws. The novel rejector member is not only field installable without requiring installation tools, but also cannot be removed from the terminal with ordinary tools.

The present invention has been described with reference to one preferred embodiment thereof; many variations and modifications will now become apparent to those skilled in the art. I do not wish, therefore, to be limited by the specific disclosure herein, but only by the scope of the appended claims.

What is claimed is:

1. A fuse terminal clip for forming an electrical connection to fuse means including a flat terminal blade having a notch formed partially therethrough, said fuse terminal clip comprising;

spaced arm means for electrically contacting opposed flat surfaces of said terminal blade, said spaced arm means adapted to resiliently capture said terminal blade in a gap therebetween;

biasing means for urging said spaced arm means together to increase the electrical conductivity between said spaced arm means and said terminal blade captured therebetween;

a rejector member extending between said spaced arm means and cooperating with said notch for rejecting a terminal blade lacking said notch and for facilitating insertion and capture between said spaced arm means only of a terminal blade provided with said notch;

collapsible retainer means carried on said rejector member for permitting placement of said rejector member between said spaced arm means and expanding upon being so emplaced to substantially prevent removal of said rejector member from said spaced arm means;

said spaced arm means including a pair of spaced parallel clip arms each having an aperture formed therethrough and the axes of both said apertures being in alignment;

said biasing means comprising a spring member having a pair of spaced arms each bearing resiliently against an associated one of said pair of clip arms and having an aperture formed therethrough in axial alignment with the aperture formed in said associated clip arms; and said rejector member extending through the aligned pair of apertures, across the gap formed between said pair of clip arms and also extending through each of the apertures in said spring arms.

2. A fuse terminal clip as set forth in claim 1, wherein a portion of each spring arm adjacent to the periphery of each aperture is swaged into the aperture of the associated clip arm to substantially lock said biasing means to said spaced arm means.

3. A fuse terminal clip as set forth in claim 1, wherein said rejector member has opposed first and second ends and a length sufficient to position each of said first and second ends respectively beyond each respective exterior surface of said pair of clip arms when said rejector member extends through said aligned apertures.

4. A fuse terminal clip as set forth in claim 3, wherein said rejector member further comprises a head integrally joined to said first end of said rejector member and having an outer diameter selected to prevent said first end from passing through said aligned apertures in a first direction; said collapsible retainer means being positioned about a portion of said rejector member intermediate said first and second ends and within said gap for preventing passage of said second end through said aligned apertures in a second direction opposite said first direction.

5. A fuse terminal clip as set forth in claim 4, wherein said rejector member intermediate portion has a generally tapering surface converging toward said head; and said collapsible retainer means is a resilient keeper spring member slidingly positioned about said tapering surface, said keeper spring member having an outer diameter greater than at least one of said clip arm aperature and said sring arm aperture when said keeper spring member slides to the widest part of said tapering portion responsive to a withdrawal force to prevent withdrawal of said second end; said keeper spring member being adapted for compression around the narrowest part of said tapering portion to permit the compressed keeper spring member to pass through said clip arm and spring apertures to be positioned within said gap.

6. A fuse terminal clip as set forth in clam 5, wherein said keeper spring member is generally C-shaped and has an outer diameter in its normal condition greater than at least one of said apertures.

7. A fuse terminal clip as set forth in claim 5, wherein the axial length of said tapering portion is selected to position said keeper spring member substantially adjacent to one of said clip arm apertures to prevent said keeper spring member from being grapsed and removed from said rejector member.

8. A fuse terminal clip as set forth in claim 1, wherein said collapsible retainer means comprisses a keeper spring retained about an intermediate portion of said rejector member and positiond within said gap for preventing passage of an end of said retainer member in a direction away from said gap.

* * * * *